US008523388B2

(12) United States Patent
Wu

(10) Patent No.: US 8,523,388 B2
(45) Date of Patent: Sep. 3, 2013

(54) PLANAR LED LIGHTING APPARATUS

(75) Inventor: Bor-Jen Wu, New Taipei (TW)

(73) Assignee: Nan Ya Photonics Inc., New Taipei (TW)

( * ) Notice: Subject to any disclaimer, the term of this patent is extended or adjusted under 35 U.S.C. 154(b) by 0 days.

(21) Appl. No.: 13/462,996

(22) Filed: May 3, 2012

(65) Prior Publication Data

US 2013/0182431 A1 Jul. 18, 2013

(30) Foreign Application Priority Data

Jan. 17, 2012 (TW) ..... 101101728 A

(51) Int. Cl.
*F21V 21/00* (2006.01)
*F21V 7/00* (2006.01)

(52) U.S. Cl.
USPC ..... 362/240; 362/97.1; 362/241; 362/249.02; 362/249.06

(58) Field of Classification Search
USPC ..... 362/612, 613, 628, 97.1, 97.2, 97.3, 362/249.02, 249.06, 240, 241, 247
See application file for complete search history.

(56) References Cited

U.S. PATENT DOCUMENTS

| | | | | |
|---|---|---|---|---|
| 7,645,048 | B2 * | 1/2010 | Iwasaki et al. | 362/84 |
| 8,052,315 | B2 * | 11/2011 | Iwasaki | 362/609 |
| 2002/0080596 | A1 * | 6/2002 | Fukiharu | 362/31 |

* cited by examiner

*Primary Examiner* — Thomas Sember
(74) *Attorney, Agent, or Firm* — Guice Patents PLLC

(57) ABSTRACT

A planar LED lighting apparatus includes a housing and multiple LEDs. The housing includes a reflective face and a light output surface opposing the reflective face. The multiple LEDs are mounted on sidewalls of the housing, and the axial light of the multiple LEDs is incident on the reflective face.

4 Claims, 5 Drawing Sheets

PLANAR LED LIGHTING APPARATUS

BACKGROUND OF THE INVENTION

1. Field of the Invention

The present invention relates to a planar lighting apparatus, especially to a planar LED lighting apparatus.

2. Description of the Related Art

Lighting is important to our daily life, and after Edison invented the light bulb, we have been in the need of lighting assemblies day and night. Current lighting assemblies mainly include incandescent light bulbs, fluorescent tubes, and compact fluorescent lamps. Compact fluorescent lamps are used to replace incandescent light bulbs to provide compatible luminance in same operation manner. Fluorescent tubes are popularly used in offices or public places of large area. As illustrated in FIG. 1, a housing 10 has four fluorescent tubes 20 inside. The fluorescent tube 20 emits light uniformly in all directions. To increase light traveling to a light output face at the bottom side of the housing 10, three reflective bodies 12 are installed in the housing 10 with each of them placed between two adjacent ones of the four fluorescent tubes 20. The light output face is equipped with an anti-dazzle grille 16 or a lampshade.

For the present, environmental protection issues of power saving, low carbon consumption, and products without mercury are highly concerned, and LEDs (light emitting diodes) happen to meet the mentioned requirements. Besides, as LEDs are solid state devices, unlike traditional fluorescent tubes made of fragile glass, therefore they are far more convenient for transportation than traditional fluorescent tubes. In addition, LEDs have the advantages of small size and directional lighting, so they are suitable to be applied in lighting applications requiring small size or directional lighting, and are therefore becoming the main choice of next generation lighting in replacing traditional fluorescent tubes.

Please refer to FIG. 2, which illustrates a cross sectional view of a prior art planar lighting apparatus using LEDs. The apparatus has a housing 10, which includes a plurality of LEDs 22, and an anti-dazzle grille 16 or a lampshade on a light output face.

Although the small size of LEDs have the advantage of being capable of reducing the thickness of a lighting apparatus, however, the small size can also make the light intensity in a unit area so high as to result in a dazzling effect. To reduce the dazzling effect, one solution is to utilize a frosted lampshade to diffuse the light rays emitted from each LED. However, the intensity of output light will be attenuated accordingly. Besides, the light emitting efficiency of LEDs has been increasing per year as the manufacturing process keeps improving, and the increased light intensity has added challenges to the diffusion effect of the frosted lampshade. Under this circumstance, the frosted lampshade has to increase scattering effect to make the output light uniform, but this will further sacrifice the intensity of the output light.

In view of the mentioned problems, the present invention proposes a planar LED lighting apparatus, which is not only capable of reducing the thickness of the lighting apparatus, but capable of using a less frosted lampshade, or even using no lampshade, to provide a uniform planar lighting.

SUMMARY OF THE INVENTION

To attain the goals mentioned above, the present invention proposes a planar LED lighting apparatus, which includes a housing and two sets of LEDs.

The housing has a light output face, a reflective face, a first side wall, and a second side wall, wherein the reflective face is opposing the light output face, the first side wall and the second side wall are opposing each other and located between the light output face and the reflective face. The two sets of LEDs are located on the first side wall and the second side wall, and each set of the two sets of LEDs has an optical axis extending toward the reflective face and forming an angle with the reflective face. The angle is preferably between 0 and 30 degrees.

The planar LED lighting apparatus of the present invention preferably further includes a first supporter placed on the first side wall and a second supporter placed on the second side wall. Both of the first supporter and the second supporter has an inclined surface for mounting the two sets of LEDs so that the optical axis of each set of the two sets of LEDs extends toward the reflective face.

In one embodiment, the planar LED lighting apparatus of the present invention further includes a transparent lampshade or a frosted lampshade on the light output face.

In one embodiment, the planar LED lighting apparatus of the present invention further includes a first half-mirror placed near a light emitting face of one set of the two sets of LEDs on the first side wall, and a second half-mirror placed near a light emitting face of the other set of the two sets of LEDs on the second side wall.

In one embodiment, the housing further has a third side wall and a fourth side wall located between the light output face and the reflective face. A third set of LEDs are mounted on the third side wall, and a fourth set of LEDs are mounted on the fourth side wall.

In one embodiment, the planar LED lighting apparatus of the present invention further includes a third supporter mounted on the third side wall and a fourth supporter mounted on the fourth side wall. The third supporter has an inclined surface for mounting the third set of LEDs, and the fourth supporter has an inclined surface for mounting the fourth set of LEDs.

In one embodiment, the planar LED lighting apparatus of the present invention further includes a third half-mirror placed near a light emitting face of the third set of LEDs on the third side wall, and a fourth half-mirror placed near a light emitting face of the fourth set of LEDs on the fourth side wall.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The present invention mainly puts LEDs on the sides or side walls of a housing, and proposes a design to make the axial light of the LEDs incident on a reflective face of the housing, so as to prevent the light of the LEDs on one side from reaching the opposite side wall, and make the light reflected by the reflective face travel toward a light output face to provide a planar light source.

To set the orientation of the optical axis of LEDs, one way is to design the package structure for the LEDs, and another way is to use a supporter having an inclined surface to mount the LEDs, wherein the inclined surface can alter the direction of the optical axis of the LEDs. The present invention will be described in more detail hereinafter with reference to the accompanying drawings that show the preferred embodiments of the invention.

Figure 1:
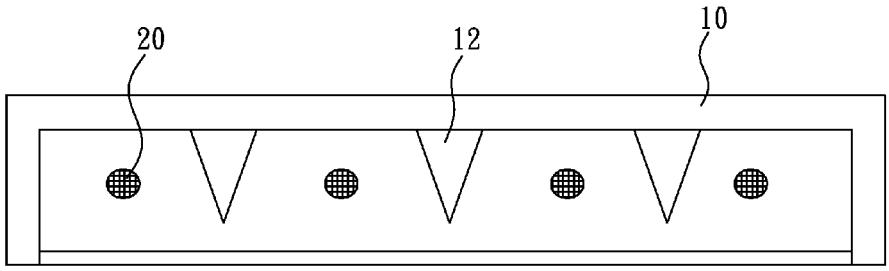
(PRIOR ART) FIG. 1
FIG. 1 illustrates a cross sectional view of a prior art planar lighting apparatus using fluorescent tubes.
Figure 2:
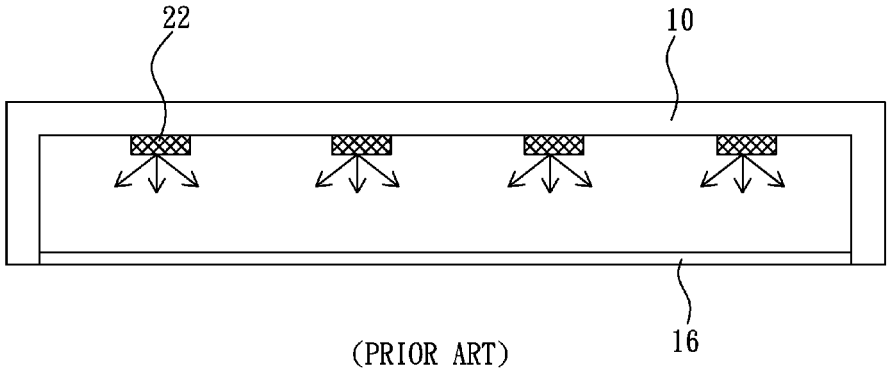
(PRIOR ART) FIG. 2
FIG. 2 illustrates a cross sectional view of a prior art planar lighting apparatus using LEDs.
Figure 3:
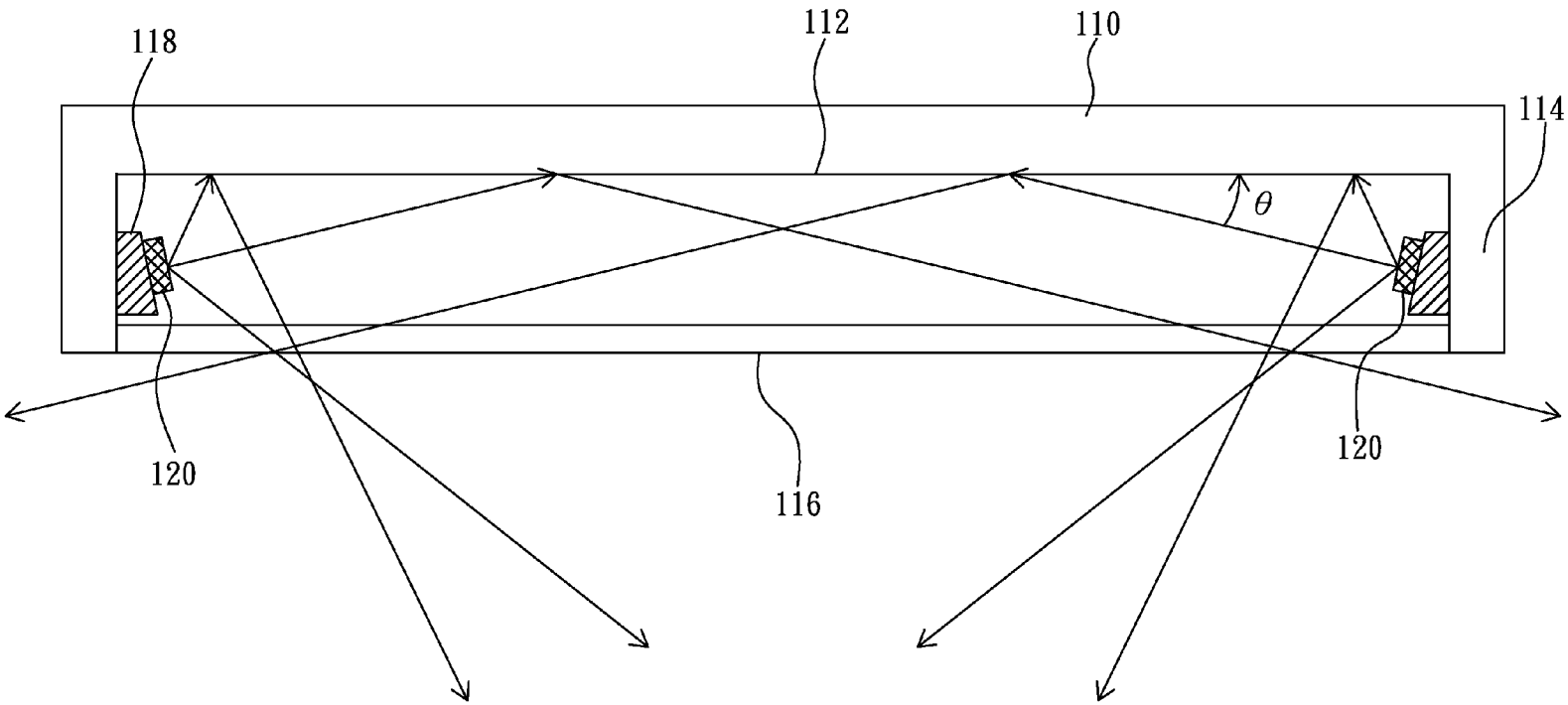
FIG. 3 illustrates a cross sectional view of a planar lighting apparatus using LEDs according to a preferred embodiment of the present invention.

Please refer to FIG. 3. A housing 110 has two side walls 114 and a reflective face 112, and a lampshade 116 is mounted on a light output face of the housing 110. Two sets of LEDs 120 are mounted on the side walls 114, and the axial light of each set of the two sets of LEDs 120 is incident on the reflective face 112 and forms an angle θ with the reflective face 112.

The material of the housing 110 can be a metal to provide a supporting structure for the whole planar lighting source. The reflective face 112 can be a metallic reflecting face or a scattering face. The scattering face can have a micro structure, and the density of the microstructure can be varying over the reflective face 112. The side region of the reflective face 112 can have a lower density for the microstructure due to a fact that it is close to the LEDs 120 and hit by more light beams, while the central region of the reflective face 112 is preferably designed to have a higher density for the microstructure to increase the chance of reflection due to a fact that it is distant from the LEDs 120 and hit by less light beams. The lampshade 116 can be a transparent lampshade, or a frosted lampshade. If the reflective face 112 has a metallic reflecting surface, the lampshade 116 is preferably a frosted lampshade to diffuse LED light and produce a uniform light source. If the reflective face 112 has a scattering surface, the lampshade 116 is preferably transparent.

General LEDs have a light emitting angle or a light pattern determined by their packaging structure, and the light pattern has a central axis. To be applied to the present invention, the packaging structure of LEDs can be designed to provide a special light emitting angle. However, a more practical design is to install a supporter 118 having an inclined surface on the side wall 114 of the housing 110, and mount the LEDs 120 on the supporter 118. By this, LEDs of general packaging structures can be used in the present invention—no special request is made on the LEDs, making the supply of the LEDs much easier. The supporter 118 can be implemented by a printed circuit board, an aluminum substrate, or a ceramic substrate. The inclined surface of the supporter 118 determines an angle θ between the optical axis of the LEDs 120 and the reflective face 112. In the present invention, the angle θ, ranging from 0 to 90 degrees, is crucial. When the angle θ is large, especially approaching 90 degrees, few light beams of the LEDs 120 can reach the central region of the reflective face 112. When the angle θ is small, especially approaching zero degrees, most light beams of the LEDs 120 will travel to the opposite side wall, and that will be adverse to the desired performance of the present invention. Therefore, a proper value of the angle θ will be one that makes the axial light of the LEDs 120 incident on the central region of the reflective face 112. Preferably, the angle θ is larger than 0 degree and smaller than or equal to 30 degrees, that is, $0° < \theta \leqq 30°$. In one embodiment, the angle θ is preferably larger than or equal to 10 degrees and smaller than or equal to 30 degrees, that is, $10° \leqq \theta \leqq 30°$.

Figure 4:
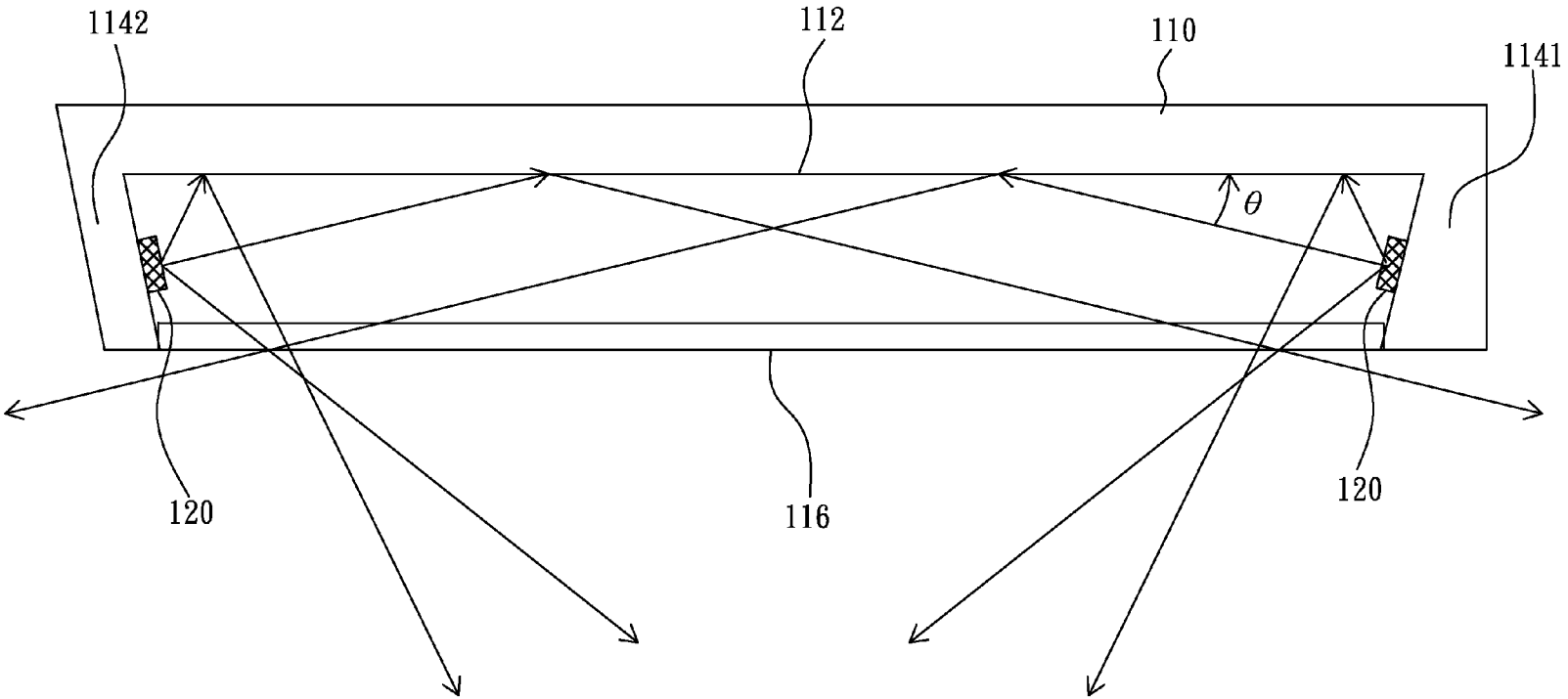
FIG. 4 illustrates a cross sectional view of a planar lighting apparatus using LEDs according to another preferred embodiment of the present invention, wherein each side wall has an inclined surface.

Besides, the side wall 114 can also be designed to have an inclined surface to get rid of the supporter 118. As illustrated in FIG. 4, one way to get rid of the supporter 118 is to provide a side wall 1141 having an inclined surface for mounting the LEDs 120, and another way is to fold a side wall 1142 inward by an angle to create an inclined surface for mounting the LEDs 120.

Figure 5:
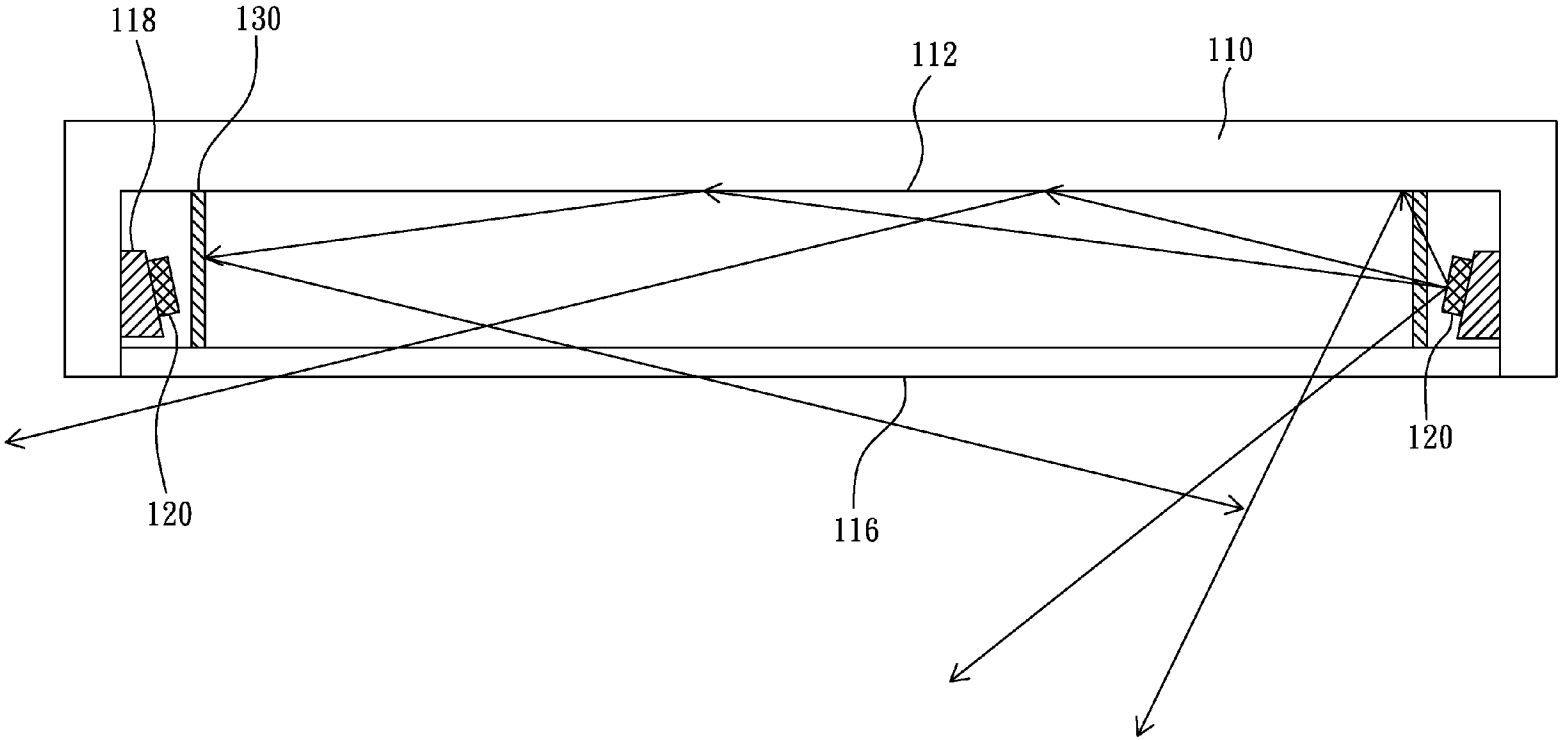
FIG. 5 illustrates a cross sectional view of a planar lighting apparatus using LEDs according to still another preferred embodiment of the present invention, wherein a half-mirror is placed near a light emitting face of the LEDs mounted on each side wall.

However, no matter what range the angle θ is in, there will still be part of the light of the LEDs 120 incident on the opposite side wall. To cope with this problem, a simple measure as illustrated in FIG. 5 can be taken. A half-mirror 130 can be placed near the light emitting face of the LEDs 120 for the light of the LEDs 120 to pass through to hit the reflective face 112. The half-mirror 130 will reflect the light, which is either indirectly from the LEDs 120 on the opposite side—the light being reflected by the reflective face 112 in the midway, or directly from the LEDs 120 on the opposite side. The light entrance face of the half-mirror 130 can also be roughened to increase light beams reaching the reflective face 112.

The half-mirror 130 can also be replaced with a polarization plate, which is capable of reflecting incident light.

The half-mirror 130 can also be replaced with a light-guiding plate to increase the uniformity of output light.

In the present invention, the LEDs can be of cold white, warm white, a specific wavelength, or a combination of different wavelengths. In one embodiment, a fluorescent powder can be formed uniformly on the half-mirror 130 to generate a light mixing effect with the LEDs 120. For example, a yellow fluorescent powder can be used to perform a light mixing with blue light LEDs to generate a white light source. The yellow fluorescent powder can be YAG (yttrium aluminum garnet), TAG (terbium aluminum garnet), or silicate, etc. Besides, the white light source can also be provided by using a fluorescent powder of multiple light colors to go with LEDs of a specific color. For example, a fluorescent powder of green light and red light can be used to go with LEDs of blue light, and a fluorescent powder of three primary colors can be used to go with LEDs of ultraviolet light to produce white light. Fluorescent powder of different light colors can be attained by mixing nitrides, sulfides, or silicates, etc.

Figure 6:
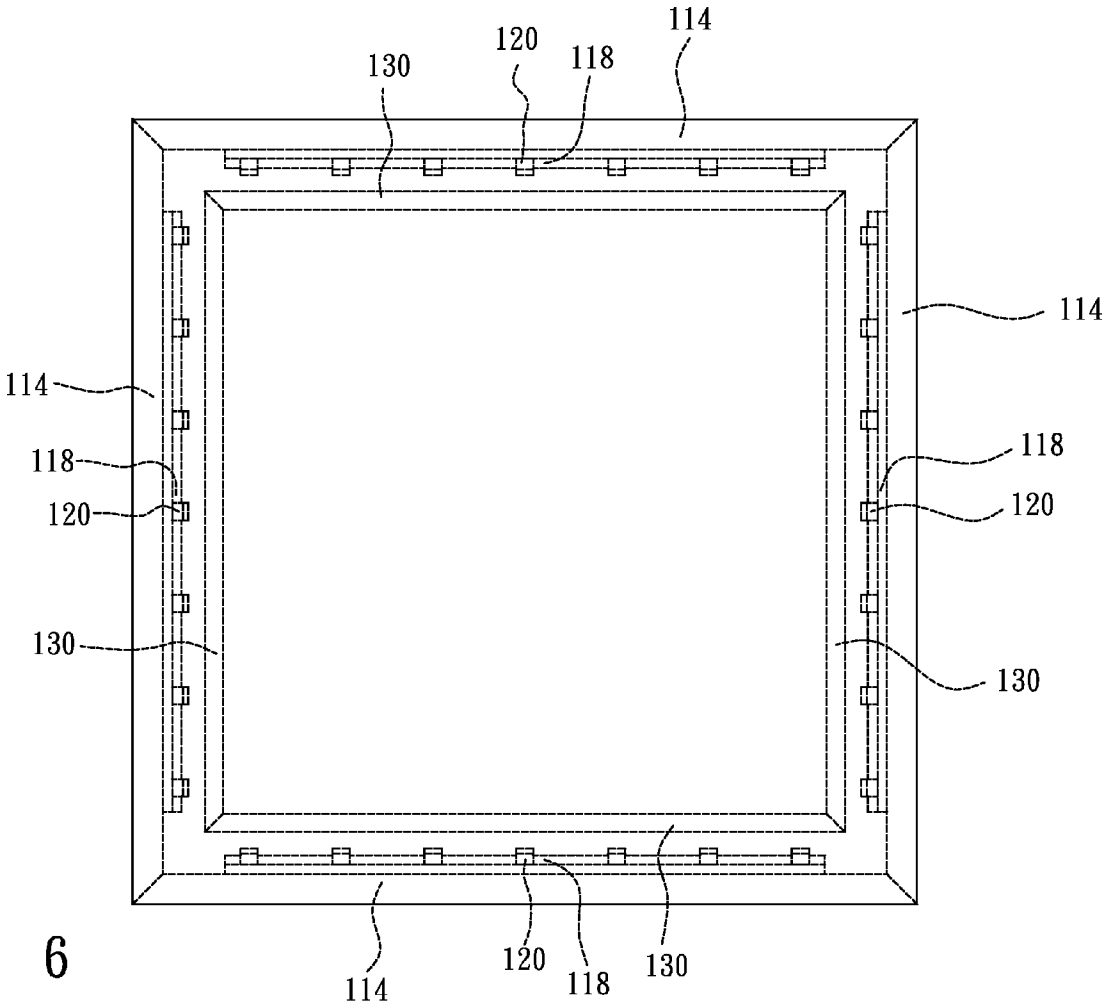
FIG. 6 is a schematic view illustrating the assembly of a planar lighting apparatus having four side walls.

In the embodiments of FIGS. 3-5, two sets of LEDs are mounted on two opposite side walls. In fact, as illustrated in FIG. 6, the housing 110 is of rectangular shape, so there will be four side walls. The two opposite side walls 114, as illustrated in FIGS. 3-5, represent both two opposing side walls (the first side wall and the second side wall) and two opposing front and rear side walls (the third side wall and the fourth side wall) of the housing 110. In practical applications, each of the four side walls 114 can be mounted with LEDs 120 to enhance light intensity. If the light intensity of LEDs is sufficient, we don't have to install LEDs on all the four side walls 114; instead, LEDs can be mounted only on two neighboring side walls or two opposite side walls. For illustration purposes, FIGS. 3-5 illustrate LEDs 114 mounted on two opposite walls 114 which are either the first side wall and the second side wall, or the third side wall and the fourth side wall.

As illustrated in FIGS. 3-6, the housing can have the third side wall 114 and the fourth side wall 114 located between the light output face and the reflective face 112. A third set of LEDs 120 are mounted on the third side wall 114, and a fourth set of LEDs 120 are mounted on the fourth side wall 114.

As illustrated in FIG. 3, the planar LED lighting apparatus of the present invention can include a third supporter 118 mounted on the third side wall 114 and a fourth supporter 118 mounted on the fourth side wall 114. The third supporter 118 can have an inclined surface for mounting the third set of LEDs 120, and the fourth supporter 118 can have an inclined surface for mounting the fourth set of LEDs 120.

As illustrated in FIG. 4, the side wall 114 can also be designed to have an inclined surface to get rid of the supporter 118. As illustrated in FIG. 4, one way to get rid of the supporter 118 is to provide a side wall 1141 having an inclined surface for mounting the LEDs 120, and another way is to fold a side wall 1142 inward by an angle θ to create an inclined surface for mounting the LEDs 120.

As illustrated in FIG. 5, The planar LED lighting apparatus of the present invention can include a third half-mirror 130 placed near a light emitting face of the third set of LEDs 120 on the third side wall 114, and a fourth half-mirror 130 placed near a light emitting face of the fourth set of LEDs 120 on the fourth side wall 114.

The present invention, using light reflection to provide a planar LED light source, can have more uniform light output than traditional designs do, and can be free of a frosted lampshade, which is for light diffusion, to reduce light attenuation. To reduce light attenuation caused by reflection, the present invention is preferably designed to have one time reflection.

While the invention has been described by way of example and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. A planar LED lighting apparatus, comprising:

a housing, having a light output face, a reflective face, a first side wall, and a second side wall, wherein said reflective face is opposing said light output face, said first side wall and said second side wall are opposing each other and located between said light output face and said reflective face;

two sets of LEDs, mounted on said first side wall and said second side wall, wherein each set of said two sets of LEDs has an optical axis extending toward said reflective face and forming an angle with said reflective face, and said angle is larger than 0 degree and smaller than or equal to 30 degrees;

a first supporter mounted on said first side wall and a second supporter mounted on said second side wall, wherein both of said first side wall and said second side wall have an inclined surface for mounting said two sets of LEDs, so that said optical axis of each set of said two sets of LEDs extends toward said reflective face; and a first half-mirror placed near a light emitting face of one set of said two sets of LEDs on said first side wall, and a second half-mirror placed near a light emitting face of the other set of said two sets of LEDs on said second side wall.

2. The planar LED lighting apparatus as claim 1, further comprising a lampshade on said light output face.

3. The planar LED lighting apparatus as claim 2, wherein said lampshade is a transparent lampshade or a frosted lampshade.

4. A planar LED lighting apparatus, comprising:

a housing, having a light output face, a reflective face, a first side wall, and a second side wall, wherein said reflective face is opposing said light output face, said first side wall and said second side wall are opposing each other and located between said light output face and said reflective face;

two sets of LEDs, mounted on said first side wall and said second side wall, wherein each set of said two sets of LEDs has an optical axis extending toward said reflective face and forming an angle with said reflective face, and said angle is larger than 0 degree and smaller than or equal to 30 degrees;

said housing further comprises a third side wall and a fourth side wall, which are located between said light output face and said reflective face;

a third set of LEDs on said third side wall, and a fourth set of LEDs on said fourth side wall;

a third supporter mounted on said third side wall, and a fourth supporter mounted on said fourth side wall, wherein said third supporter has an inclined surface for mounting said third set of LEDs, and said fourth supporter has an inclined surface for mounting said fourth set of LEDs; and a third half-mirror placed near a light emitting face of said third set of LEDs on said third side wall, and a fourth half-mirror placed near a light emitting face of said fourth set of LEDs on said fourth side wall.

* * * * *